US006431944B1

(12) United States Patent
Norman et al.

(10) Patent No.: US 6,431,944 B1
(45) Date of Patent: Aug. 13, 2002

(54) TOY

(75) Inventors: Casey William Norman, London; David Gamlin, Bath; Tony Thatcher, Bristol, all of (GB)

(73) Assignee: Genie Toys, plc. (GB)

( * ) Notice: Subject to any disclaimer, the term of this patent is extended or adjusted under 35 U.S.C. 154(b) by 226 days.

(21) Appl. No.: 09/606,096

(22) Filed: Jun. 28, 2000

(51) Int. Cl.[7] ..... A63H 17/26

(52) U.S. Cl. ..... 446/470; 446/94; 446/99; 296/136; 150/166

(58) Field of Search ..... 446/470, 99, 97, 446/95, 94, 93, 471, 269, 279, 275; 40/589, 590, 591, 592; 150/166, 167; 296/136

(56) References Cited

U.S. PATENT DOCUMENTS 1,987,463 A * 1/1935 Brethen ..... 280/827
3,411,797 A * 11/1968 Wild ..... 280/1.175
3,920,239 A 11/1975 White
4,188,748 A 2/1980 Rich et al.
4,551,109 A * 11/1985 Hanson ..... 446/465
4,943,256 A * 7/1990 Symons et al. ..... 180/7.1
4,997,229 A * 3/1991 Swanson ..... 150/166
5,464,214 A * 11/1995 Griffin ..... 273/148 B
5,490,707 A * 2/1996 De La Cruz ..... 150/166
5,549,313 A * 8/1996 James et al. ..... 280/1.13
5,791,077 A * 8/1998 Felber ..... 40/592
5,845,958 A * 12/1998 Rudys et al. ..... 150/166

FOREIGN PATENT DOCUMENTS

GB 2 171 320 A 8/1986

* cited by examiner

*Primary Examiner*—Derris H. Banks
*Assistant Examiner*—Urszula M Cegielnik
(74) *Attorney, Agent, or Firm*—Schnader Harrison Segal & Lewis LLP

(57) ABSTRACT

A toy including at least one endless stretchable loop supporting or defining a figure or representative object, the toy being sized and shaped for removable placement around a toy wheeled vehicle by tension exerted by the loop against selected exterior portions of the toy wheeled vehicle.

19 Claims, 1 Drawing Sheet

TOY

FIELD OF THE INVENTION

This invention relates, in a first aspect, to a toy capable of attachment to a toy wheeled vehicle and, in a second aspect, to a combination of a toy wheeled vehicle and a toy capable of attachment thereto.

BACKGROUND

Toy cars, in particular die-cast miniatures, have enjoyed popularity for generations. However, such die-cast miniatures, once manufactured, essentially have the same appearance for the remainder of their useful life. For younger children particularly, it is highly desirable to provide a toy wheeled vehicle that is capable of changing appearance, to provide variation in the appearance of the wheeled vehicle and to permit their imagination to allow for more interesting and extended play.

There have been a number of attempts in the toy art to provide for various means to alter the appearance of an object or a person, such as is disclosed in U.S. Pat. Nos. 3,920,239 and 4,188,748, as well as in GB 2 171 320 A. However, these efforts have not provided a suitable means for altering the appearance of toy wheeled vehicles in a cost-effective and easy to use manner. Also, there is no means available to alter many different wheeled vehicles using the same toy. Accordingly, it is an aim of the invention to provide a toy which alters the appearance of a toy wheeled vehicle and allows for more varied and imaginative play.

SUMMARY OF THE INVENTION

The invention provides a toy including at least one endless stretchable loop supporting or defining a figure or representative object, wherein the toy is capable of being removably held in place around a toy wheeled vehicle by tension exerted in the loop.

Preferably, the toy is capable of being held in place around the vehicle without interfering with rotation of the vehicle's wheels. Thus, the figure or representative object is located on top of the vehicle and the loop(s) include(s) a thin strip intended to underlie the vehicle.

The invention also provides, in combination, a toy wheeled vehicle and a toy as defined above.

BRIEF DESCRIPTION OF THE DRAWINGS

The invention will now be described in more detail, by way of example only, with reference to the accompanying drawings, in which.

DETAILED DESCRIPTION OF THE INVENTION

Figure 1:
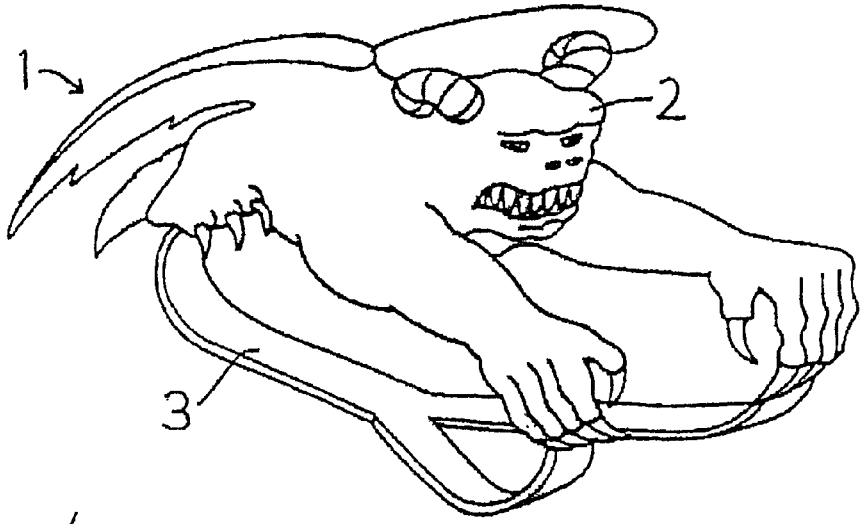
FIG. 1 shows a perspective view of a toy according to an embodiment of the invention.

It will be appreciated that the following description is intended to refer to specific embodiments of the invention selected for illustration in the drawings and is not intended to define or limit the invention, other than in the appended claims.

Figure 2:
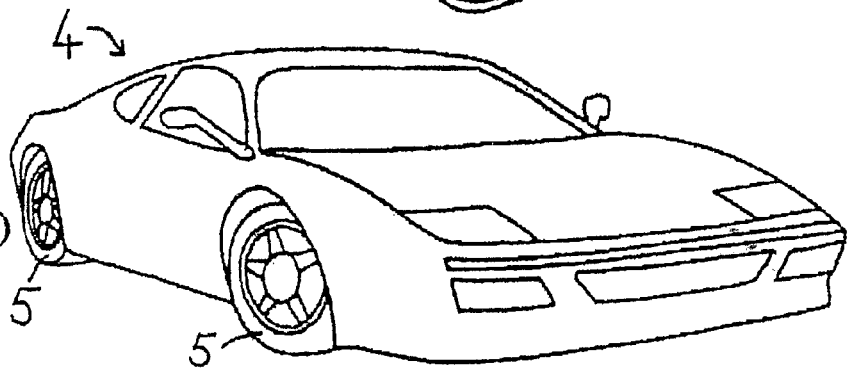
Fig. 2 (Prior Art)
FIG. 2 shows a perspective view of a toy car to which the toy of FIG. 1 can be fitted.

FIG. 1 shows a toy 1, comprising a demon-like FIG. 2 and a strip 3 joining the fingertips of the figure to its tail. The strip 3 is branched into a Y shape, one branch being attached to each hand of the figure. It will be appreciated that FIG. 2 and strip 3 together form an endless, stretchable loop. Preferably, FIG. 2 and strip 3 are integrally molded together.

Preferably the toy, comprising the stretchable loop and the figure or object, is integrally molded from an elastomeric material or rubber. Preferably, the toy is molded from a single mold in one operation and preferably the figure or object itself is part of the loop. It is also possible to mold a flat strip and either attach it to the figure, thus forming the endless loop, or to form the strip into the endless loop before attaching the figure.

Suitable elastomeric materials include, but are not limited to, ethylene vinyl acetate copolymer, polyurethane, and one, or a mixture of more than one, of the following polymers sold under the Registered Trade Mark "Kraton" by Shell Chemical Co.: (optionally hydrogenated) styrene-butadiene-styrene, styrene-isoprene-styrene, styrene-diene, styrene-isoprene and styrene-butadiene block copolymers, styrene-ethylene-butylene block copolymer containing mineral oil, branched styrene copolymer, styrene-butadiene rubber, styrene-butadiene triblock rubber, styrene-isoprene-styrene linear block polymer, styrene-butadiene radial block copolymer, butadiene-styrene copolymer rubber, synthetic rubber and the like.

The toy 1 is made by molding the material in a mold of the desired shape and then decorating at least a portion of the toy with paint or varnish having a modulus of elasticity similar to that of the elastomeric material.

The internal surface of the toy 1 is preferably of a size and shape which conform to those of a die-cast toy car 4, of known type, shown in FIG. 2. The car 4 has rotatable wheels 5 which allow the car to roll when pushed. Also, the size of the toy is calculated such that the internal space formed by FIG. 2 and strip 3 is smaller than the outer surface of the vehicle to which it is applied so that a tension will be created to hold the toy in position on the vehicle.

Figure 3:
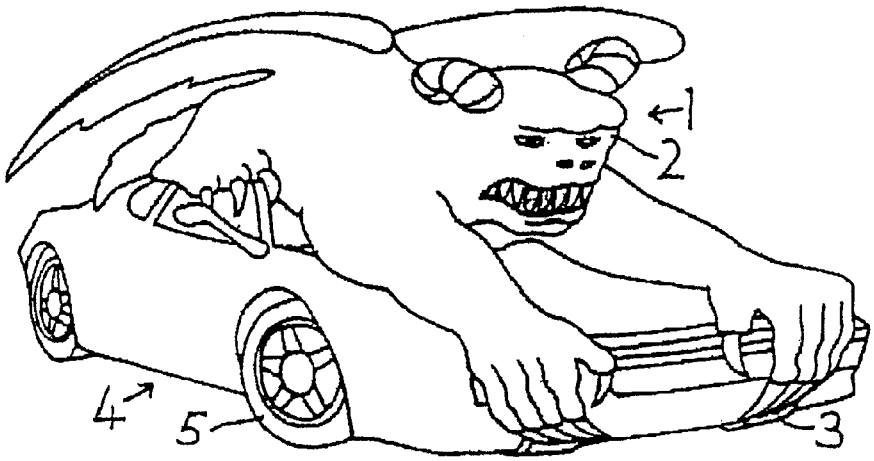
FIG. 3 shows a perspective view of the toy of FIG. 1 fitted to the car of FIG. 2.

FIG. 3 shows how the toy 1 can be fitted around the car 4, with the FIG. 2 overlying the car and the strip 3 underlying it. The thickness of the strip 3 is less than the distance by which the wheels 5 protrude from the underside of the car 4 and, therefore, rolling motion of the car is not impeded by the presence of the toy 1.

It will be appreciated that instead of a figure, the toy of the invention could comprise another representative object, for example, enabling the appearance of the vehicle to be transformed into that of a different vehicle. Also, although a "demon" FIG. 2 has been selected for illustration, those of ordinary skill in the art will appreciate that other forms of living beings such as human figures or heads, animals (e.g. lions, tigers or the like), cartoon characters and various other imaginary beings may be substituted. Also, a logo or logo plaque/plate may be substituted as well. Whilst the toy may have an internal surface shaped and dimensioned for fitting to a toy vehicle of a particular size and shape, its elasticity will allow it to be fitted around vehicles of different sizes and shapes. This allows a child to transform any one of a number of different vehicles that may already form a child's vehicle collection.

The toy can comprise one or more endless, optionally branched loops. The or each loop may be intended to extend transversely around the vehicle (i.e., substantially perpendicular to the direction of motion) instead of, or in addition to, extending longitudinally as shown. Additionally, if the vehicle's wheels do not protrude laterally from the vehicle, the loop can be arranged to extend horizontally around the periphery of the vehicle instead of passing underneath the vehicle, the toy then essentially comprising a membrane stretchable over the upper surface of the vehicle.

What is claimed is:

1. A toy comprising at least one endless stretchable loop supporting or defining a figure or representative object, said toy being sized and shaped for removable placement around a toy wheeled vehicle by tension exerted by the loop against selected exterior portions of the toy wheeled vehicle.

2. The toy according to claim 1, wherein a portion of the stretchable loop is sized and shaped to avoid interference with wheels on the vehicle.

3. The toy according to claim 2, wherein the figure or representative object is locatable on top of the vehicle and the loop comprises a thin strip positionable under the vehicle.

4. The toy according to claim 1, wherein the representative object is shaped as an alternative vehicle.

5. The toy according to claim 1, comprising at least one branched stretchable loop.

6. The toy according to claim 1, wherein the loop is integrally molded to the figure or representative object from an elastomeric material.

7. The toy according to claim 1, further comprising a paint or varnish decorative coating.

8. The toy according to claim 1, wherein the elastomeric material is selected from the group consisting of ethylene vinyl acetate copolymer, polyurethane, styrene-butadiene-styrene, styrene-isoprene-styrene, styrene-diene, styrene-isoprene, styrene-butadiene block copolymers, styrene-ethylene-butylene block copolymer containing mineral oil, branched styrene copolymer, styrene-butadiene rubber, styrene-butadiene triblock rubber, styrene-isoprene-styrene linear block polymer, styrene-butadiene radial block copolymer, butadiene-styrene copolymer rubber, synthetic rubber and mixtures thereof.

9. In combination, a toy comprising:

at least one endless stretchable loop supporting or defining a figure or representative object, said toy being sized and shaped for removable placement around a toy wheeled vehicle by tension exerted by the loop against selected exterior portions of the toy wheeled vehicle; and a toy wheeled vehicle.

10. A toy adapted for application to a toy wheeled vehicle comprising:

a decorative object at least partially made from an elastic material and sized and shaped for positioning at an exterior top portion of the vehicle; and a strip at least partially made from an elastic material having end portions connected to corresponding end portions of the decorative object to thereby form an endless stretchable loop and sized and shaped for positioning at an exterior under portion of the vehicle.

11. The toy according to claim 10, wherein the decorative object and the strip are integrally molded together.

12. The toy according to claim 10, wherein the decorative object is an animal or imaginary being having at least one pair of legs extending in a common direction and the strip has a branched portion connected to the legs.

13. The toy according to claim 10, wherein substantially all of the decorative object and the strip are made from the elastic material.

14. The toy according to claim 10, wherein the elastic material is selected from the group consisting of ethylene vinyl acetate copolymer, polyurethane, styrene-butadiene-styrene, styrene-isoprene-styrene, styrene-diene, styrene-isoprene, styrene-butadiene block copolymers, styrene-ethylene-butylene block copolymer containing mineral oil, branched styrene copolymer, styrene-butadiene rubber, styrene-butadiene triblock rubber, styrene-isoprene-styrene linear block polymer, styrene-butadiene radial block copolymer, butadiene-styrene copolymer rubber, synthetic rubber and mixtures thereof.

15. The toy according to claim 10, wherein the decorative object and the strip are sized and shaped to extend around the vehicle from end to end.

16. The toy according to claim 10, further comprising a paint or varnish coating applied to at least a portion of the decorative object.

17. The toy according to claim 10 in combination with the vehicle.

18. A toy adapted for application to a toy wheeled vehicle comprising:

a decorative object made from an elastic material sized and shaped for positioning at an exterior top portion of the vehicle; and a strip made from an elastic material having end portions integrally molded to corresponding end portions of the decorative object and sized and shaped for positioning at an exterior under portion of the vehicle, to thereby form an endless stretchable loop wherein the decorative object and the strip extend around the vehicle from end to end.

19. The toy according to claim 18 in combination with the vehicle.

* * * * *